US005727270A

United States Patent [19]

Cope et al.

[11] Patent Number: 5,727,270

[45] Date of Patent: Mar. 17, 1998

[54] VALVELESS SELF SEALING FLUID OR GAS CONTAINER

[75] Inventors: Dennis Allen Cope; John Edward McGrath, both of Castro Valley, Calif.

[73] Assignee: AirCelTec Inc., Hayward, Calif.

[21] Appl. No.: 477,431

[22] Filed: Jun. 7, 1995

[51] Int. Cl.[6] ..... A47C 27/08

[52] U.S. Cl. ..... 5/710; 5/55.3; 5/706; 141/114; 141/313; 206/522; 206/591

[58] Field of Search ..... 141/10, 114, 313; 5/449, 451, 453, 455, 456, 706, 710, 712, 655.3; 206/522, 591, 592

[56] References Cited

U.S. PATENT DOCUMENTS

| | | | |
|---|---|---|---|
| 4,076,872 | 2/1978 | Lewicki et al. . | |
| 4,547,919 | 10/1985 | Wang | 5/455 |
| 4,651,369 | 3/1987 | Guldager | 5/455 |
| 4,674,532 | 6/1987 | Koyanagi | 137/512.15 |
| 4,850,912 | 7/1989 | Koyanagi . | |
| 4,854,481 | 8/1989 | Bohl et al. | 141/114 |
| 4,860,397 | 8/1989 | Gusakov | 5/455 |
| 4,983,138 | 1/1991 | McGrath | 446/224 |
| 5,044,030 | 9/1991 | Balaton | 5/455 |
| 5,245,719 | 9/1993 | Ott | 5/632 |
| 5,261,466 | 11/1993 | Koyanagi | 141/10 |
| 5,351,828 | 10/1994 | Becker et al. . | |
| 5,447,235 | 9/1995 | Pharo . | |

FOREIGN PATENT DOCUMENTS 08989 6/1996 WIPO .

*Primary Examiner*—Steven N. Meyers
*Assistant Examiner*—Tuyet-Phuong Pham
*Attorney, Agent, or Firm*—Brumbaugh, Graves, Donohue & Raymond

[57] ABSTRACT

The invention is an inflatable self sealing valveless fluid or gas container useable for a wide variety of applications including cushioning, package filler, mattresses, rafts and the like. The container is formed from one or more inflatable self sealing elements, each inflatable element being formed from a pair of inflatable cells. Each cell is formed from an inner and outer sheet of thermoplastic or other impermeable material, the sheets being sealed together at boundaries which define the inflatable cell. The inner sheets of each cell in the pair are sealed together such that the boundaries of the seal define a fill channel through which fluid or gas may pass between the cells. Apertures in the inner sheets of both cells within the fill channel allow fluid or gas to pass from the fill channel into both cells to cause inflation. Upon the cells being inflated to capacity, internal gas pressure and lateral stretching forces cause the inner sheets of the cells to come into contact, which causes the fill channel to close, thereby isolating the apertures from the external environment and effectuating the self sealing action of the container. The container may further be created using arrays of such self sealing elements that can be individually inflated or inflated from a single source feeding a common manifold.

36 Claims, 9 Drawing Sheets

VALVELESS SELF SEALING FLUID OR GAS CONTAINER

BACKGROUND OF THE INVENTION

The present invention relates to self sealing inflatable or fillable cellular containers which can hold a fluid or gas. A wide variety of plastic fluid containers are known in the art which can be used, for example, as cushioning material, package filler, mattresses, rafts or boats or other similar applications. Examples of inflatable cellular assemblies wherein individual cells are isolated or compartmentalized such that a leak or rupture of one cell should not disturb other cells or compartments include U.S. Pat. No. 4,850,912 to Koyanagi, U.S. Pat. No. 4,651,369 to Guldager and U.S. Pat. No. 4,076,872 to Lewicki et al. It is the object of this invention to provide numerous improvements and advantages over such prior art.

Accordingly, it is an object of this invention to provide an improved cellular container wherein each cellular element is self sealing upon inflation such that for containers having a plurality of cellular elements, rupture of any single cellular element will not cause deflation of the remaining cellular elements comprising the container, wherein such container may be formed from ordinary flat sheets of thermoplastic or other impermeable material, without a need for pre-formed cells.

It is a further object of the invention to provide an improved self sealing container wherein no independent valves are required to prevent the egress of gas or fluid and the self sealing action is activated only through the use of the container surface materials.

It is a further object of this invention to provide an improved self sealing cellular container where the self sealing action results from internal fluid or gas pressure and lateral stretching forces acting on the individual cells of the container.

It is a further object of this invention to provide an improved multi-celled container where each cellular element can be inflated individually or all cellular elements can be inflated substantially simultaneously through a common manifold.

It is a further object of the invention to provide an improved cellular container that can be stored in an uninflated configuration to be inflated and deflated by the ultimate end user as desired.

It is a further object of the invention to provide an improved cellular container that is inexpensive and easily produced on a commercial scale, and can be dimensioned to allow a variety of customized applications.

Other objects and purposes will be apparent to those skilled in the art upon review of the detailed description of the invention.

SUMMARY OF THE INVENTION

The present invention relates to self sealing inflatable containers which consist of one or more self sealing inflatable elements, each element formed from a first and second inflatable cell whose inner layers are sealed together to form a pair of cells arranged such that upon inflation the inner surfaces of the cells interact to prevent deflation.

Preferably, each first and second cell is formed from an inner and outer layer of thermoplastic material or other impermeable material sealed together such that the seal between the inner and outer layers define the boundaries of each inflatable cells. There is no need to pre-form or mold the thermoplastic layers to create the cells; flat sheets of thermoplastic material may be used.

The inner layers of the first and second cells are further heat sealed together to form a fill channel between the cells. The fill channel dimensions are defined by the boundary of the heat seal between the inner sheets of the first and second cell. The fill channel has an opening such that gas or fluid may be injected into the fill channel from an external source. Within the fill channel there are apertures in the inner sheets of the first and second cells. These apertures, spaced from the opening in the fill channel, allow gas or fluid injected into the fill channel to pass into and inflate each cell through the inner layers.

In operation, gas or fluid is injected into the opening in the fill channel. The gas or fluid flows down the fill channel and through the apertures in the inner sheets of the first and second cells. As gas or fluid inflate the cells to capacity, pressure internal to each cell and lateral stretching forces caused by expansion of the cell act to force the fill channel to close, thereby effectuating the self sealing valveless action.

These self sealing inflatable elements can be arranged in arrays of pairs of cells of varying design, specific embodiments of which are shown by the examples in the preferred embodiments detailed below. The arrays of self sealing inflatable elements can be easily and inexpensively constructed by heat sealing sheets of thermoplastic material to form arrays of inflatable elements connected in parallel or any other desired geometric configuration.

While each inflatable element can be individually inflated, it is also possible to provide for a common passage which runs adjacent to the opening of each fill channel, such that all inflatable elements (i.e., all pairs of cells) can be inflated from a single source. It is possible to define this common passage by an additional seal between the inner layers of the arrays of inflatable cells or by a seal between an additional sheet of thermoplastic material and the inner sheet of one of the arrays of cells.

The arrays of inflatable cells may be arranged in a variety of configurations for use, for example, as packing material, cushioning, envelope mailers, mattresses, rafts, or other applications. Additional aspects and advantages of the invention will be apparent to those skilled in the art upon review of the preferred embodiments and the corresponding drawings detailed below.

FIG. **4*a*** is a blow-up of a lengthwise cross-section of a single inflatable element prior to inflation.

FIG. **4*b*** is a blow-up of a lengthwise cross-section of a single inflatable element during the inflation process.

FIG. **4*c*** is a blow-up of a lengthwise cross-section of a fully inflated inflatable element.

FIG. **4*d*** is a horizontal cross-section of a fully inflated inflatable element.

Figure 5:
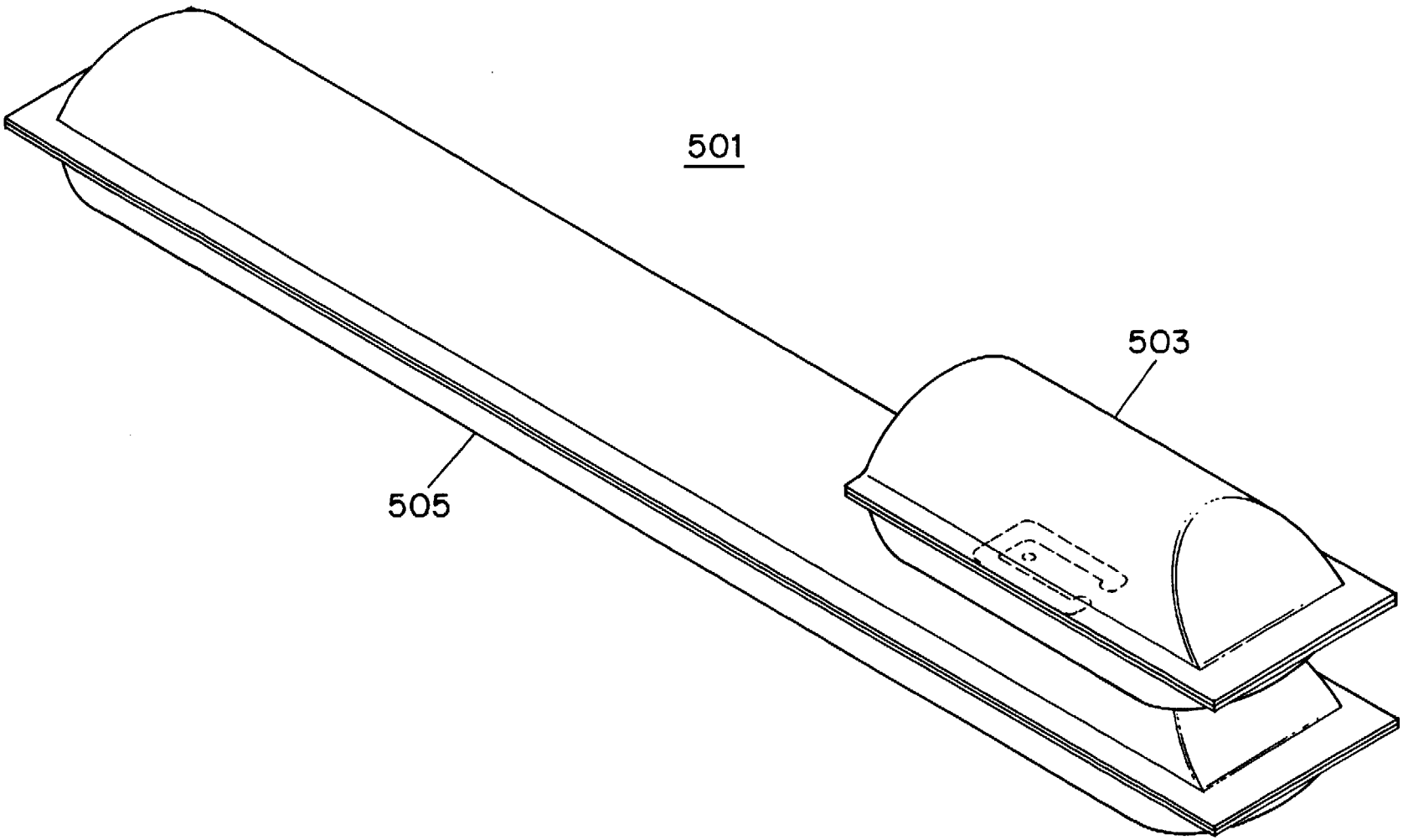

FIG. 5 is a perspective view of a single inflatable element created from a pair of cells of different sizes.

Figure 6:
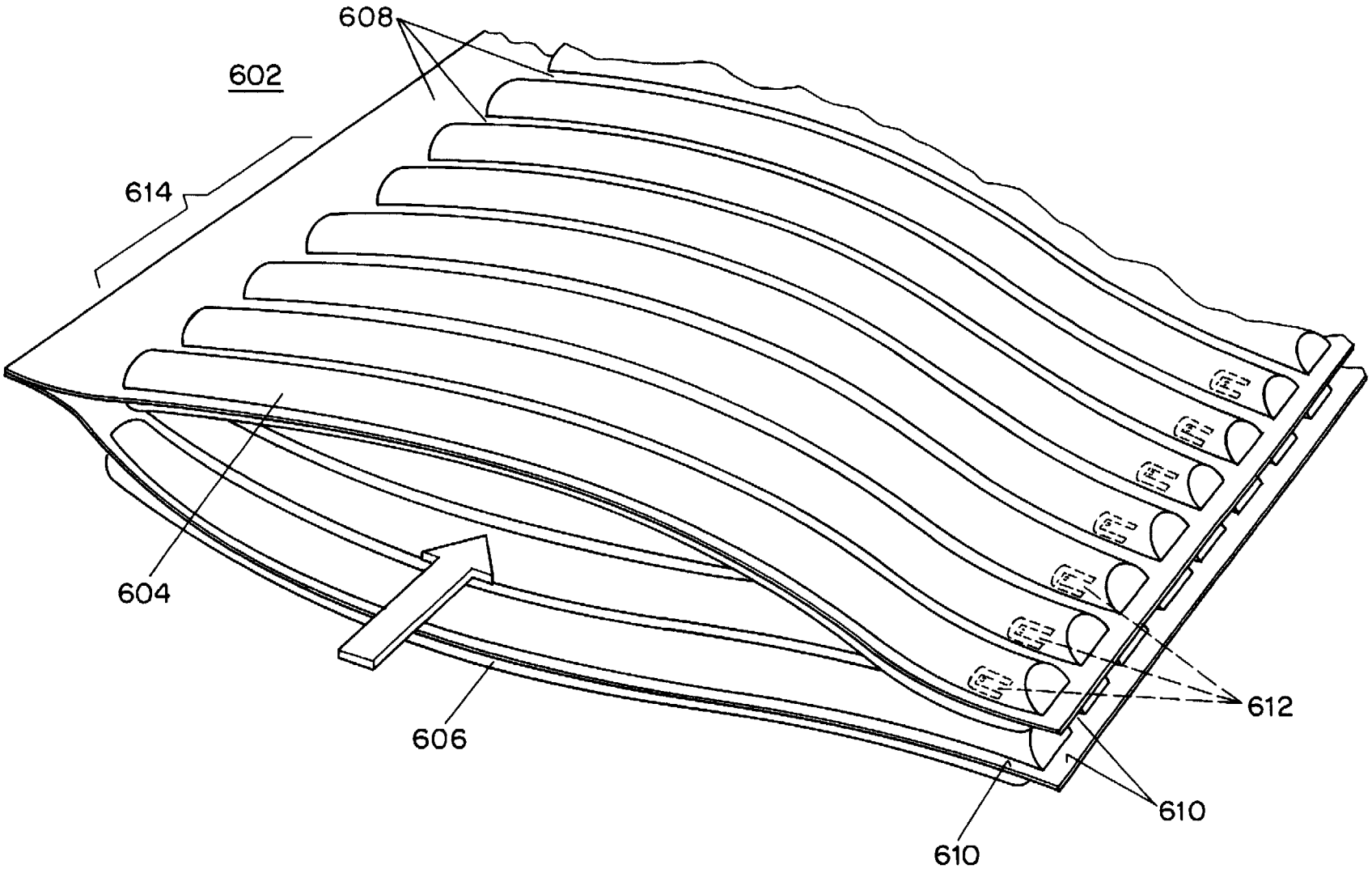

FIG. 6 is a perspective view of an array of inflatable elements formed to create a cushioned pouch.

Figure 7A:
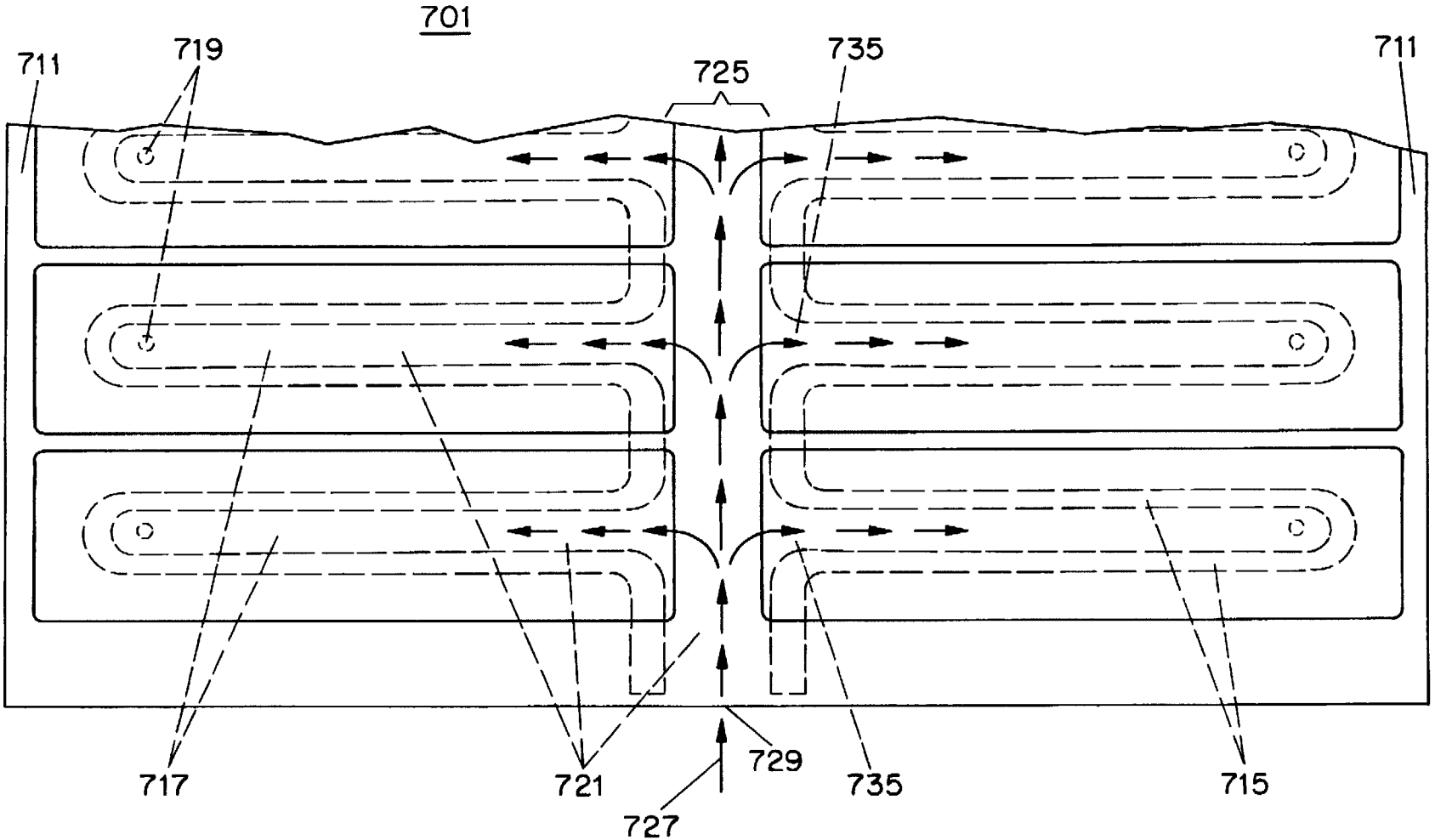

FIG. 7*a* is a top view of an array of inflatable elements with a common central fluid channel such that all inflatable elements can be inflated from a single source.

Figure 7B:
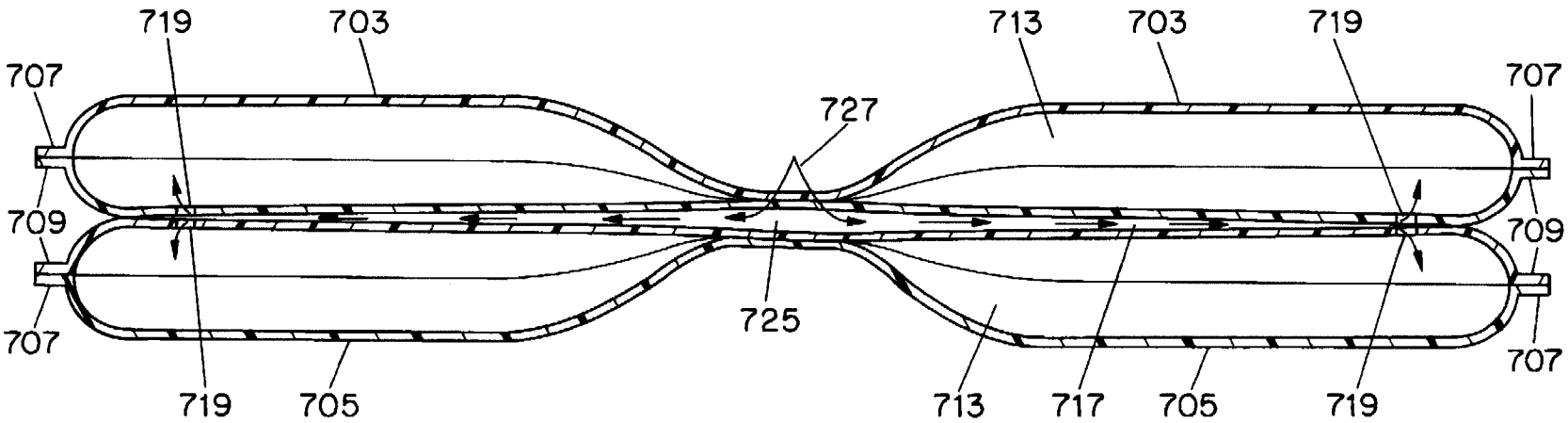

FIG. 7*b* is a horizontal cross-section of an array of inflatable elements with a common central fluid channel such that all inflatable elements can be inflated from a single source.

Figure 8A:
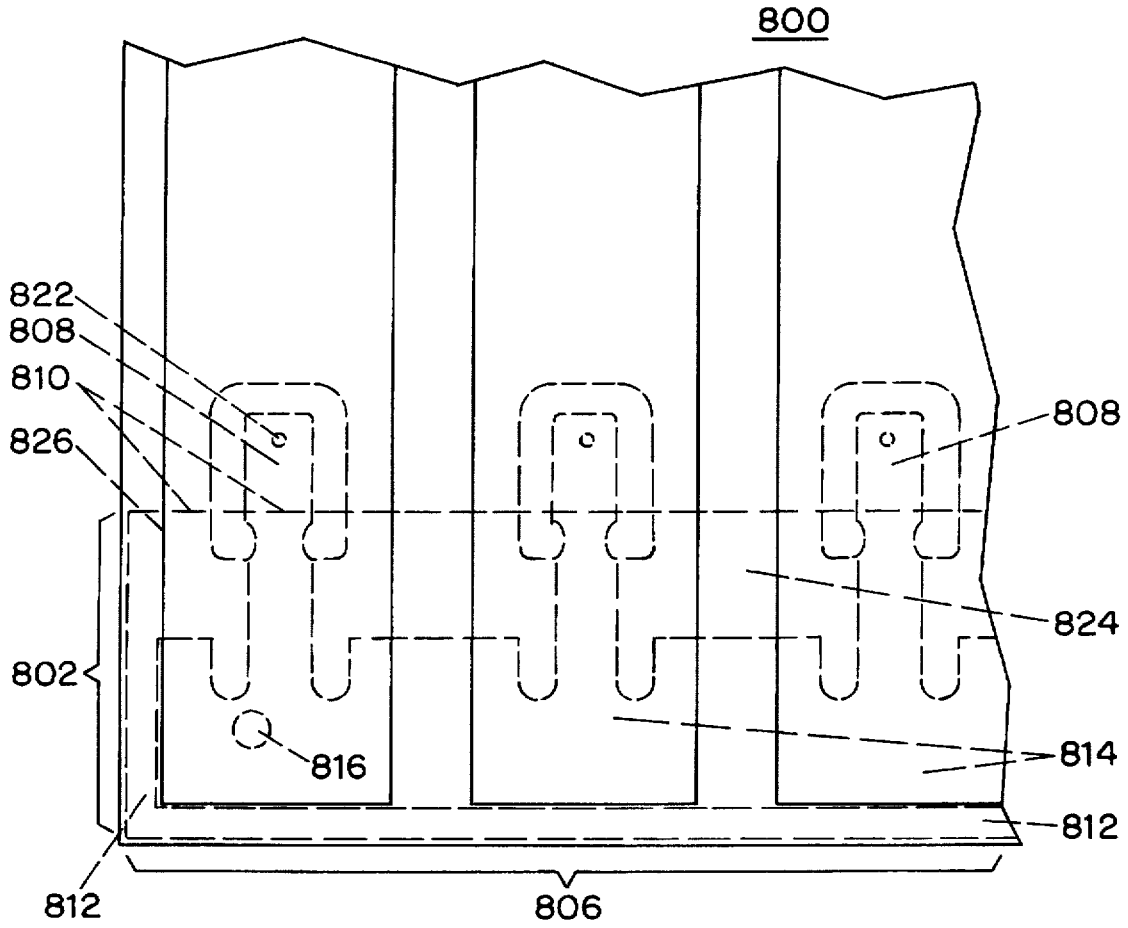

FIG. 8*a* is a top view of an array of inflatable elements with a common manifold and common fluid channel formed using an additional strip of thermoplastic material. The cells of the array may be inflated from a single source or inflated and deflated individually.

Figure 8B:
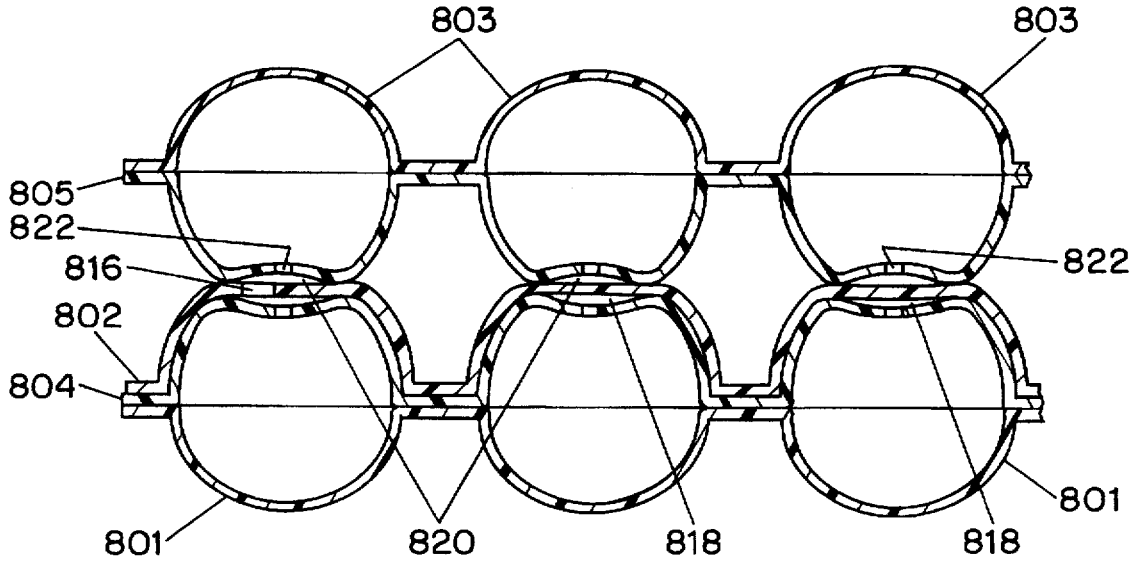

FIG. 8*b* is a horizontal cross-section of an array of inflatable elements with a common manifold and common fluid channel formed using an additional strip of thermoplastic material. The cells of the array may be inflated from a single source or inflated and deflated individually.

DETAILED DESCRIPTION OF THE INVENTION

The invention is described herein with reference to several exemplary embodiments.

Figure 1:
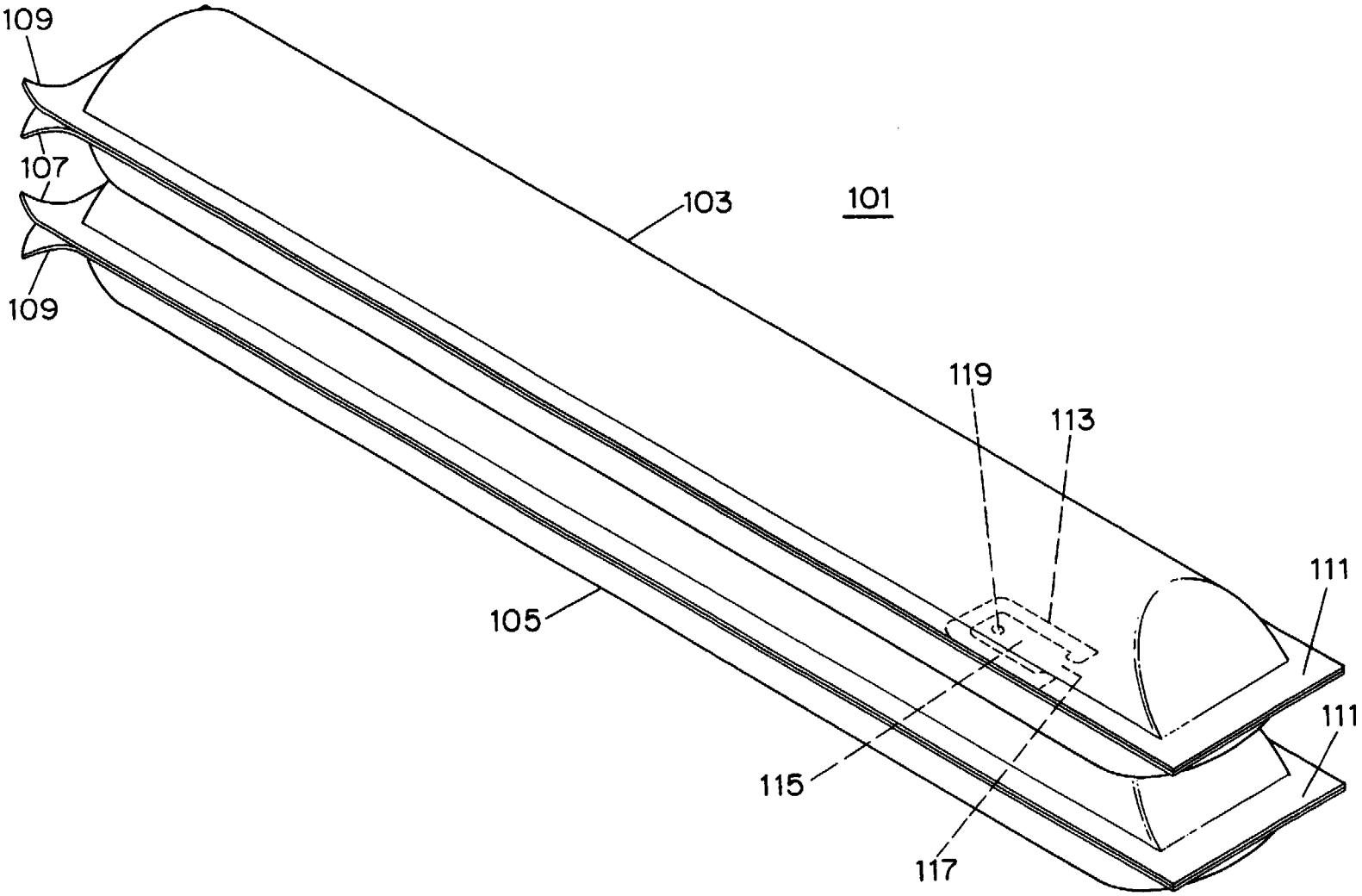
FIG. 1 is a perspective view of a single self sealing inflatable/fillable element formed from a top and bottom cell, e.g., a pair of inflatable cells.

Turning now to FIG. 1 there is shown a single inflatable element (101) which is the basic building block for all embodiments of the invention. The final inflatable container may have virtually unlimited configurations as arrays of inflatable elements are arranged together.

Each inflatable element (101) is formed from two cells, a first cell (103) and a second cell (105). Each first and second cell is formed from two layers of thermoplastic or other impermeable material. While the preferred embodiment is detailed using thermoplastic layers such as polyethylene, it is envisioned that any fluid or gas impermeable material may be substituted, such as mylar, vinyl or the like. Ordinary flat sheets of thermoplastic or other material may be used. There is no need to pre-form or mold the sheets unless distinctly shaped cells are desired. Use of ordinary flat sheets will result in cells having generally circular or elliptical cross-sections. A pleated or waffle design may be heat sealed into the inner and outer sheets to limit the cell cross-section upon inflation.

Each cell in the preferred embodiment has an inner layer (107) and an outer layer (109) of thermoplastic material. The boundaries of each first (103) and second (105) cell are defined by heat seals which provide an airtight boundary between the thermoplastic layers along the perimeter of each cell. The heat sealed border (111) is visible in FIG. 1 for both the first and second cells. The heat seal border (111) shown have a generally rectangular configuration, however, cells of any desired shape can be formed in practicing the invention.

The inner layers (107) of the first and second cells are also heat sealed together such that the inflatable element (101) is formed from an integrated pair of cells. The seal (113) between the inner layers (107) is dimensioned to form a fill channel (115) preferably running longitudinally between each pair of cells through which fluid or gas may pass from an external source. Fluid or gas may be injected into the fill channel through the opening (117) in the fill channel between the cells. Apertures (119) are provided in the inner sheets of both the first and second cells within the fill channels. The apertures (119) are spaced from the opening (117). The apertures (119) allow fluid or gas injected through the fill channel (115) to flow into each first and second cell (103, 105).

Figure 2:
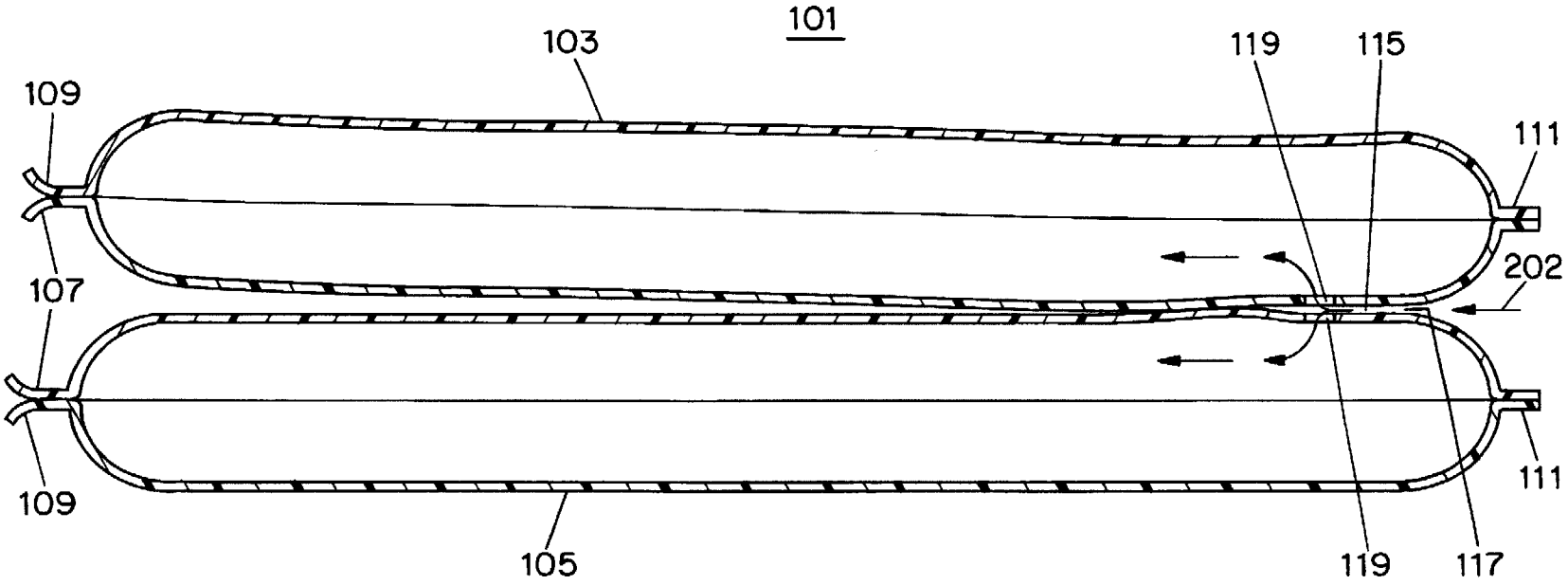
FIG. 2 is a lengthwise cross-section of a single self sealing inflatable element comprising two inflatable cells formed from four sheets of thermoplastic material and inflated to capacity.

FIG. 2 shows a lengthwise cross-section of the inflatable element (101) wherein the flow of injected fluid or gas is shown schematically. External fluid or gas, the flow of which is represented by arrows (202), is injected through the opening (117) between the inner layers (107) of the first and second cells (103, 105) and into the fill channel (115). The fluid or gas flows through the fill channel (115) and is forced through the apertures (119) to inflate the cells.

Figure 3:
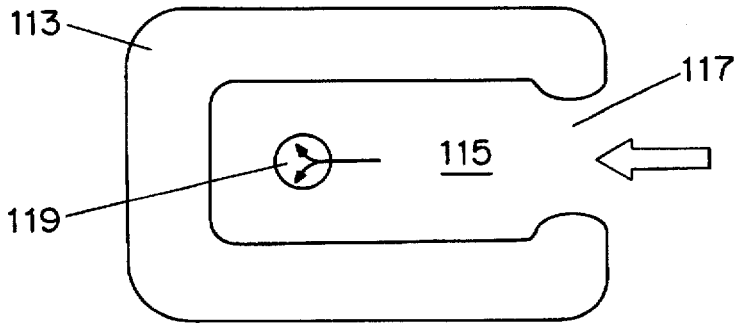
FIG. 3 is a blow-up of the heat seal between the inner sheets of the pair of cells comprising each inflatable element; the seal defining a fill channel with an aperture through which gas can flow to each cell.

A top down view of the seal (113) between the inner sheets (107) forming the fill channel (115) is shown expanded in FIG. 3. The channel is shown in a generally rectangular format. It may, of course, be of any extended geometry as long as the apertures (119) are spaced from the opening (117) to the fill channel. There also may be more than one aperture (119) in each inner sheet (107) and more than one opening (117) for each fill channel.

Figure 4A:
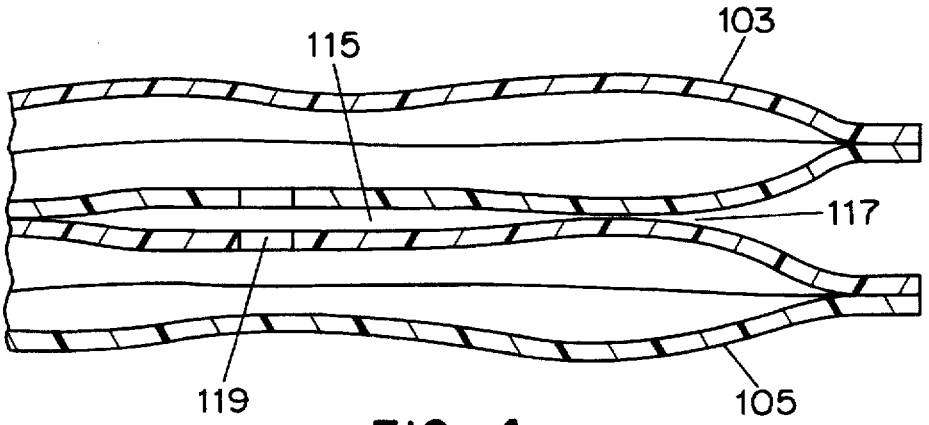

FIGS. 4*a* and *b* show the inflation sequence. The uninflated structure is shown schematically in FIG. 4*a*. In the uninflated state, ambient gas or fluid may circulate between the cells and the outside environment through the apertures (119), the fill channel (115) and the opening (117).

Figure 4B:
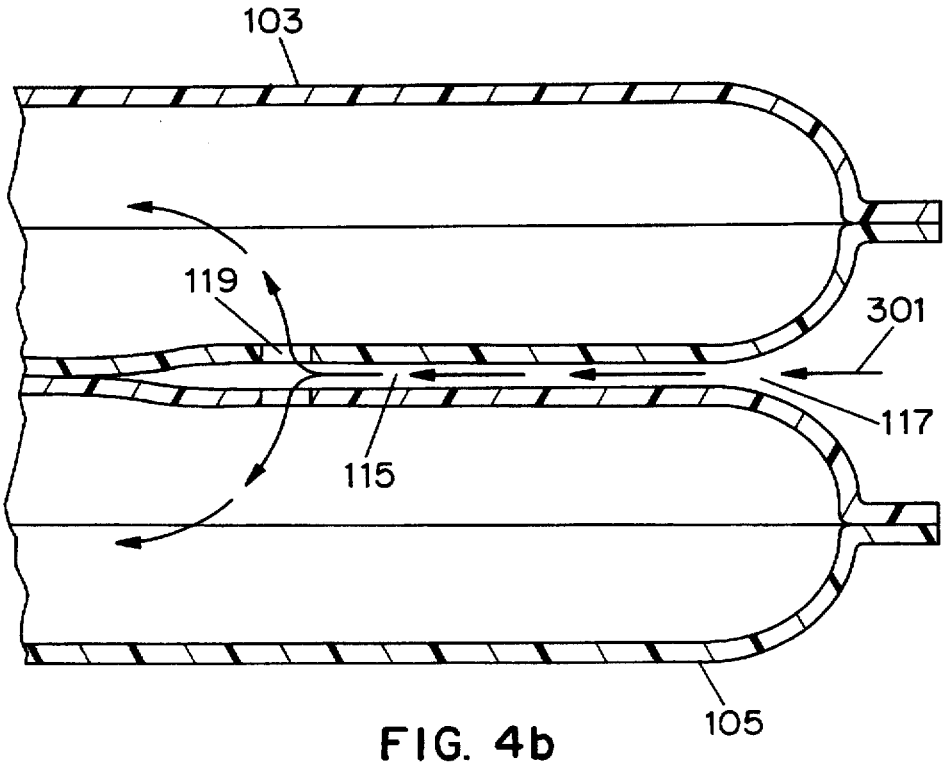

FIG. 4*b* shows the structure during inflation with arrows (301) indicating air flow. Fluid or gas may be injected into the opening (117) by means, for example, of a straw or nozzle. As the fluid or gas flows through the fill channel (115) it is forced to pass through the apertures (119) and into the cells (103, 105) causing them to inflate.

Figure 4C:
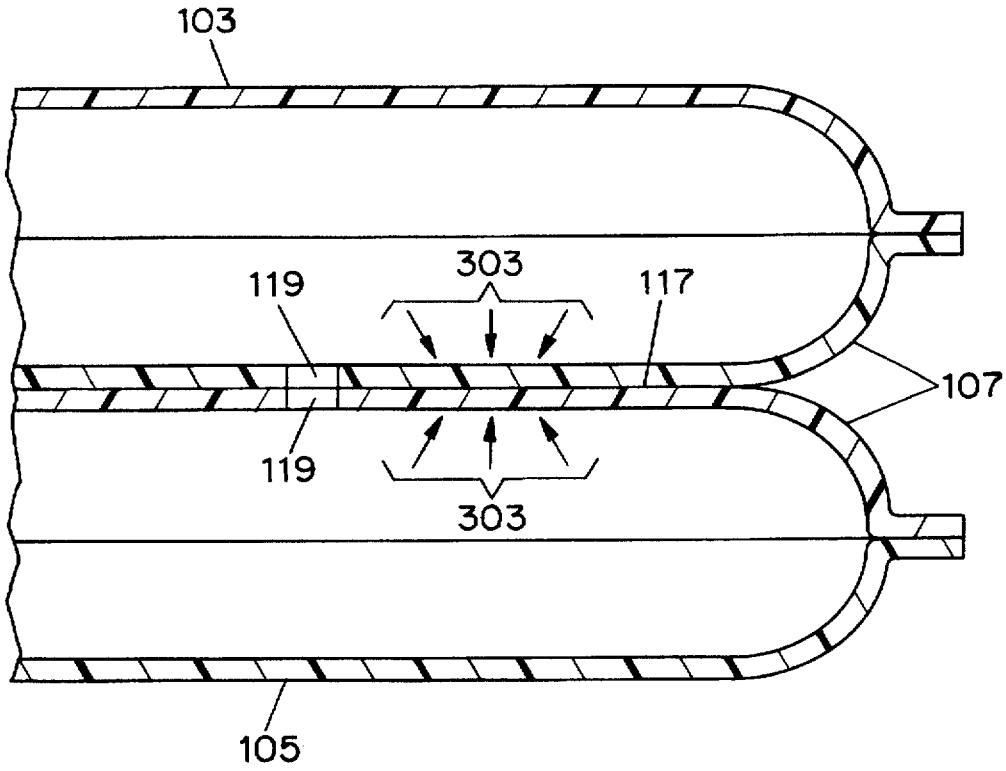
Figure 4D:
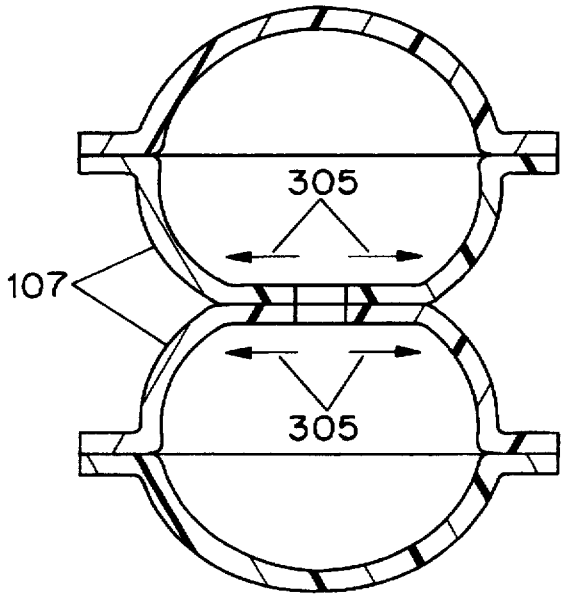

An expanded view of the fully inflated cells are shown in longitudinal and horizontal cross-sections in FIGS. 4*c* and 4*d*, respectively. As shown schematically in FIG. 4*c*, internal air pressure causes the cells to expand. Upon reaching capacity the internal air pressure and lateral/circumferential stretching forces cause the fill channel between the first and second cells to close, thereby preventing further ingress or egress of air from the structure. The internal air pressure, shown schematically by arrows (303) in FIG. 4*c*, forces the inner sheets (107) of the first and second cells (103,105) into contact, thereby isolating the apertures (119) from the opening (117) of the fill channel, and effectuating the valveless self sealing action. Lateral stretching forces, shown schematically by arrows (305) in FIG. 4*d*, also assist in creating a flush seal between the inner sheets (107) of the first and second cells (103, 105).

It is further possible to place a viscous fluid such as glycol in the fill channel (115). The presence of such viscous matter will further assist in preventing any migration or leakage of fluid or gas through the fill channel following inflation of the cells.

In the embodiment shown in FIGS. 1–4, the apertures (119) in the inner layers of the cells are coincident. It is, of course, possible to arrange the apertures (119) so that they are not aligned. When the apertures (119) are coincident, once the inflatable element is inflated and the fill channel is closed, fluid or gas may pass between the first and second cells (103, 105). This fluid or gas exchange provides an additional cushioning effect if large loads are placed on the inflatable element. If a large load is placed on top of the first cell, gas will be redistributed from the first to the second cell, thereby minimizing any danger of rupture and maintaining equal fluid or gas pressure in the adjoining cells. This redistribution of fluid has been found to provide an improved cushioning effect.

It may be noted that the embodiment of the single inflatable element shown in the figures detailed above has both the first and second cells (103, 105) with the same dimensions. The invention, however, may be practiced wherein the cells have varying sizes.

As shown in FIG. 5, the inflatable element (501) is formed from a first cell (503) which is substantially smaller in length than the second cell (505). It is further possible for the first cell to have a cross-section that varies from that of the second cell (not shown). The only limitation on length is that the cells extend at least the desired length of the fill channel. The variability in size and configuration of the inflatable elements will allow those skilled in the art to create arrays of virtually unlimited configurations for numerous customized applications. For example, cushioning/packing material formed from the disclosed inflatable container may be dimensioned to precisely fit the goods being shipped.

Several basic exemplary configurations of arrays of inflatable elements shall now be discussed in conjunction with FIGS. 6–8.

FIG. 6 shows a container (602) composed of a plurality of inflatable elements of the type shown in FIG. 1. The container is formed from two arrays of inflatable cells (604, 606). The first array of cells (604) is formed from two sheets, an inner and outer sheet, of thermoplastic material heat sealed together such that the boundaries of the heat seals (608) define the inflatable cells. As shown in FIG. 6, the heat seals (608) which define the cells include a perimeter seal for the entire array plus longitudinal seals intersecting the perimeter seal at opposite ends of each cell. Similarly, the second array of inflatable cells (606) is formed from an outer and inner sheet of thermoplastic material. The sheets are similarly heat sealed together such that the boundaries of the heat seals (610) define the inflatable cells. Each cell in the first array (604) is aligned with and attached to a corresponding cell in the second array (606) forming pairs of cells (610). The cells in each array (604, 606) are shown arranged in parallel; however, any desired configuration may be used as long as pairs of cells are created to provide the self sealing action for each inflatable element.

The inner layers of the cells in the first and second arrays are attached by heat seals. These heat seals are dimensioned to form fill channels (612) of the type shown in FIG. 3, such that each pair of cells forms an inflatable element of the type shown in FIG. 1. Each element can thus be inflated by injecting fluid or gas into each fill channel opening between each pair of cells.

Each pair of cells is inflated by inserting a straw, nozzle or the like into the fill channel opening and injecting fluid or gas such that it passes through the apertures to inflate each pair of cells (610). The fully inflated container (602) shown in FIG. 6 has all four thermoplastic layers heat sealed at the terminal end (614). The fluid container, therefore, describes a pouch that is suitable, for example, for use as an envelope for shipping fragile goods. The container can be stored in a flat uninflated configuration and deployed in any width, i.e., any number of inflatable elements, desired.

It will be readily apparent to those skilled in the art that numerous variations to the embodiment shown in FIG. 6 are possible. For example, it is possible to seal each cell at its longitudinal midpoint, i.e., halving each cell, and to place a second set of fill channels for each pair of cells at the terminal end (614) of the array, thereby doubling the number of inflatable elements forming the array. Of course, the more individually sealed elements that comprise a container, the less overall impact a rupture of any given cell will have on the overall integrity of the container.

The embodiments detailed above require that each self sealing inflatable element (101) be filled individually by injecting fluid or gas through the opening (117) of each fill channel (115). It is possible, however, to configure a container having a plurality of inflatable elements such that all inflatable elements can be filled from a common source.

This, for example, is illustrated in FIGS. 7*a* and *b* which show an inflatable container formed from two arrays of cells, top and bottom, each having a plurality of cells, and a common central fluid/gas channel.

FIG. 7*a* shows the container (701) with two arrays of cells arranged in parallel (only the first, or top, array of cells is visible in the figure). The array as shown has fill channels (717) extending from both sides of a common central fluid/gas channel (725). To enable common inflation, the top and bottom arrays are attached by heat seals (715) which form a common manifold between the arrays which allows fluid or gas to be distributed to each cell when injected into the manifold opening.

FIG. 7*b* shows a horizontal cross-section of the container wherein both layers, top cells (703) and bottom cells (705), are visible. Both layers of cells (703,705) are formed from an outer sheet (707) and an inner sheet (709) of thermoplastic material. The cells are defined by the boundaries (711) of heat seals between the inner and outer sheets (707, 709) of the thermoplastic material. As shown, the boundaries are defined by a perimeter seal and longitudinal seals running the length of the cells. The cells of the top and bottom layers (703,705) are arranged in parallel such that each cell in the top array (703) has a corresponding cell in the bottom array (705), thereby creating the pairs of cells (713) which form the individual inflatable elements.

As with the single inflatable element (101) and the array of inflatable elements (602) discussed above, each pair of cells is attached by a heat seal (715) between the inner layers (709) of the cells. The boundaries of the heat seals (715) between the inner layers define a common fluid/gas manifold (721) which includes fill channels (717) and a common fluid channel (725). The fill channels (717) of FIG. 7*a* extend almost the entire length of each inflatable cell, as opposed to the relatively short fill channels of the configurations detailed previously. The length of the fill channel may be dimensioned as desired. Preferably, within and at the end of each fill channel are apertures (719) in the inner sheets of each cell. The apertures (719) (there may be more than one in each cell) allow fluid or gas to flow from the fill channels into each cell.

As shown in FIG. 7*a*, fluid or gas is not injected directly into each fill channel (717). Rather, the common manifold (721), formed between the inner sheets (709) of the top array of cells (703) and the bottom array of cells (705), has an opening (729) which feeds each pair of cells. The common central manifold is sealed by heat seals (715), except for the opening (729) through which fluid or gas may be injected. It is, of course, possible to replace the opening (729) with an inflation valve, or other inflation means such as a bellows pump, a bladder pump or a self contained chemical inflation system, at any desired position within the manifold (721).

FIGS. 7*a* and *b* display arrows (727) to depict the flow of fluid or gas flow into the container. In operation, fluid or gas is injected into the common manifold opening (729). The fluid passes through the common fluid/gas channel (725) and flows into each fill channel (717). Fluid or gas then passes the length of each fill channel and flows into each cell through the apertures (719) to inflate each cell. As described above, upon reaching capacity, pressure within each cell and lateral stretching forces act to press the inner layers (709) against each other, thereby closing the fill channels (717), and causing the self sealing action. Ingress and egress of fluid or gas from each pair of cells is, thereby, prevented.

The array shown in FIGS. 7*a* and *b* can be stored and deployed in any length desired (parallel to the common fluid/gas channel), in a similar manner to the array shown in FIG. 6. The specific configuration shown in FIGS. 7*a* and *b* has a common fluid channel running down the center of the array through which fluid flows into each fill channel. It will be apparent to those skilled in the art that the common fluid channel (725) need not be centrally located; it only need be adjacent to the opening (735) of each fill channel (717) such that a common fluid/gas manifold, formed from the fill channels and common fluid channel, is created. Accordingly, the common fluid channel could be located, for example, along an edge of the array perpendicular to the cells, in which case the array would resemble the left or right half of the symmetric configuration shown in FIG. 7*a*. Alternatively, the common fluid channel could be at an intermediate position, in which case the cells on the left and right side of the array shown in FIG. 7*a* would have different sizes. The final configuration is, of course, user definable.

It is further possible to provide for an embodiment similar to that shown in FIGS. 7*a* and 7*b* where the common manifold is created but without a central fluid/gas channel (725). Instead of using a central channel to directly feed each fill channel (717) it is possible to provide a circumferential seal between all four thermoplastic layers along the perimeter of the entire container. An opening in the surface of the container allowing access between the inner sheets (709), or an opening between the inner sheets in the circumferential or perimeter seal, at a corner of the container for example, will allow fluid or gas to be injected between the arrays of cells. The opening may have a check valve to further restrict the egress of fluid or gas. As fluid or gas is injected between the arrays, the circumferential seal between all four layers will confine the fluid or gas, thereby forcing it to circulate and flow down the fill channels to inflate the cells.

It will be apparent to those skilled in the art that in such a configuration the openings (735) to the fill channels need not be located along the center of the arrays as shown in FIGS. 7*a* and *b*. In fact, while the embodiment shown in FIGS. 7*a* and *b* requires the openings (735) to the fill channels to be adjacent to the common fluid channel (725), when a circumferential seal between all four layers is provided instead of the central fluid/gas channel (725) there are no restrictions on the locations of the openings or the alignment of the fill channels and cells. The openings to the fill channels need only be contained within the circumference of the container to ensure fluid or gas will flow through the openings and down each fill channel to inflate each pair of cells. Accordingly, various arrays of cells of varying geometric configurations can be constructed, i.e., "quilted," where a circumferential seal will force fluid or gas through each fill channel regardless of fill channel location or orientation. It is simply required that pairs of cells be formed or "quilted" into the container such that the opening to the fill channel between each pair of cells is within the circumferential seal between all four layers of impermeable material.

It may be noted that in the embodiment of the invention shown in FIGS. 7*a* and *b* and the variations discussed above, the individual inflatable elements, formed from pairs of cells, cannot be individually inflated and deflated, as is the case with the examples shown in FIGS. 1–6. It is, however, possible to construct an array having a plurality of inflatable elements, where both the container can be filled from a single source, and the individual elements can be inflated and deflated individually.

FIGS. 8*a* and *b* show an embodiment of the invention containing a plurality of pairs of cells, i.e., inflatable elements, wherein the individual inflatable elements can be inflated and deflated individually or the entire array can be inflated from a single source substantially simultaneously. From a perspective view, the array will appear substantially the same as that shown in FIG. 6.

FIGS. 8*a* and *b* show a fillable container (800) composed from an array of pairs of cells arranged in parallel. The principal variation of the embodiment shown in FIGS. 8*a* and *b* from the embodiment of FIG. 6 is the use of an additional strip of thermoplastic material (802). The additional strip of material (802) is sealed to the inner sheet (804) of the first array of cells (801) in such a way as to create a common manifold such that all cells can be inflatable from a common source. Specifically, the strip of material (802) extends along the entire width of the array perpendicular to the cells adjacent to the fill channels (808). The strip (802) extends from the widthwise perimeter seal (806) into the fill channels (808). The strip ends at an intermediate section (810) of the fill channel (808) such that it does not reach the apertures (822). The portion of the additional strip which is sealed to the inner sheet (804) of the first array (801) is shown as the shaded area (812) in FIG. 8*a*. The widthwise perimeter seal (806), seals (824) connecting the fill channels (808) of adjacent inflatable elements, and end seals (826) connecting the end of the widthwise perimeter seal to the opening of the fill channels of the outermost cells in the array form the seal (812) which attaches the additional strip to the inner sheet (804) of the first array.

The result of the seals (812) is to create a fluid/gas manifold similar to that in FIG. 7*a*. The manifold, consisting of the fill channels (808), a common fluid channel (814) and passageways (818) connecting the common fluid passage (814) to the fill channels (808), runs between the additional plastic strip (802) and the inner sheet (804) of the first array (801). The common fluid channel (814) is provided with an opening (816) in the additional plastic sheet such that fluid or gas may be injected into the fluid manifold. The opening (816) may be provided with a valve or other means to aid in inflation, such as a bellows pump, a bladder pump or a self contained chemical inflation system.

In the operation, the container (800) may be inflated in two ways. First, all cells may be inflated from a single source substantially simultaneously by injecting fluid or gas into the manifold through the opening (816) in the additional strip of material (802). Fluid or gas injected into the opening (816) will flow through the common fluid channel (814) and pass through the passageways (818) within the fill channel between the inner layer (804) and the additional strip and into each fill channel (808). As with the embodiments heretofore described, the fluid or gas flows down the fill channels (808) inflating each cell as fluid or gas passes through the apertures (822). As the cells reach capacity, internal fluid or gas pressure and lateral stretching forces cause the fill channels (808) to close, thereby isolating the apertures (822) from the outside, effectuating the self sealing action. It may be noted that upon closure of the fill channels (808), the edge (810) of the additional strip (802) within the fill channel provides an additional barrier to assist in providing an airtight seal upon inflation.

The second manner in which the array (800) can be inflated is to directly inject gas into the fill channel (808) of each inflatable element, i.e., between each pair of cells, as was prescribed for the inflation of the array shown in FIG. 6. A straw or nozzle may be inserted between the additional strip of material (802) and the inner layer (805) of the second array of cells (803). Injection of fluid or gas through a straw or nozzle inserted into the openings (820) in the fill channel between the additional strip of material (802) and the inner layer (805) of the second array will cause fluid or gas to pass into each fill channel (808) and, thereby, cause each cell to inflate as the fluid or gas passes through the apertures (822) in the inner layers (804, 805) of the arrays within the fill channel. As each pair of cells reach capacity the self sealing action closes the fill channels as described above. Each inflatable element may thus be individually inflated and deflated by inserting a straw or the like into each fill channel. Accordingly, the embodiment shown in FIGS. 8*a* and *b* provides the flexibility of allowing inflation from a single source while allowing the user to deflate and reuse the individual elements of the container as desired.

While the invention has been described in conjunction with the foregoing specific embodiments, it will be apparent to those skilled in the art that various alterations and modifications may be made to the described embodiments without departing from the scope of the invention, as defined by the appended claims. For example, manufacturers and users may wish to assemble arrays of inflatable elements in varied geometric configurations for customized use. Further, cells of various lengths and cross-sections may be desirable for customized applications. The structures detailed in the disclosure of the exemplary embodiments are provided merely by way of example.

We claim:

1. A fluid container comprising at least one self sealing inflatable element, each element comprising:

(a) first and second inflatable cells, each cell comprising an outer and inner layer of fluid impermeable material sealed together such that the seal between the outer and inner layers defines boundaries of each inflatable cell, the inner layer of the first and second cell being sealed together to form a pair of cells;

(b) a fill channel between the pair of cells defined by the seal between the inner layers of the first and second cells, said channel having an opening such that fluid may be injected through the opening into the fill channel and said seal between the inner layers of the first and second cells defining the fill channel being separate from and inward of the seals defining the boundaries of each cell in each pair of cells; and (c) a first and second aperture within the fill channel spaced from the opening, said first aperture being formed in the inner layer of the first cell, said second aperture being formed in the inner layer of the second cell, such that fluid injected through the opening into the fill channel may pass through the apertures to inflate the inflatable cells, the fill channel being forced to close as the cells are inflated, thereby effectuating a self sealing action by preventing fluid from exiting or entering the cells.

2. The fluid container of claim 1, wherein the inner and outer layers of the cells of each array are a thermoplastic material.

3. The fluid container of claim 1, wherein the outer layer of the first and second cell of each element have a pleated or waffle design to restrict a cross-section of the cells upon inflation.

4. The fluid container of claim 1, wherein a viscous fluid is deposited within the fill channel of each element to further restrict fluid flow within each fill channel after inflation of the cells.

5. The fluid container of claim 1, further comprising a plurality of self sealing elements arranged in parallel wherein the cells of each element have substantially identical dimensions.

6. A self sealing container for holding a fluid comprising:

(a) a first and second array of inflatable cells, each array formed from an outer and inner sheet of fluid impermeable material, said outer and inner sheets being sealed together such that the seal between the outer and inner sheets defines boundaries of the inflatable cells, the inner sheets of the first and second arrays being sealed together such that such inflatable cell in the first array is sealed to a corresponding cell in the second array forming pairs of cells;

(b) a common fluid manifold comprising, a fill channel between each pair of cells defined by the seal between the inner layers of each pair of cells, each of said channels having an opening through which fluid may be injected and said seal between the inner layers of each pair of cells defining the fill channel being separate from and inward of the seals defining the boundaries of each cell in each pair of cells; and a common fluid channel connecting the openings of the fill channels and having an external opening such that fluid injected into said external opening passes through the common fluid channel and into the fill channels;

(c) first and second apertures within each fill channel spaced from the common fluid channel, said first aperture being formed in the inner sheet of the first array, said second aperture being formed in the inner sheet of the second array, such that fluid injected into the common fluid channel will flow into each fill channel and through each aperture to fill each inflatable cell, each fill channel being forced to close upon inflation of each pair of cells.

7. The self sealing container of claim 6, wherein the inner and outer sheets of each array are constructed from thermoplastic material.

8. The self sealing container of claim 6, wherein the common fluid channel defines a passage running extending substantially straight across the container and the arrays of inflatable cells extend perpendicular from the common fluid channel.

9. The self sealing container of claim 6, wherein the common fluid channel includes means for inflating the container.

10. The self sealing container of claim 9, wherein the container is stored in an uninflated configuration and may be dispensed in any longitudinal length.

11. The self sealing container of claim 6, wherein the common fluid channel defines a passage running down a central portion of the container and the arrays of inflatable cells are arranged in parallel, extending on both sides of the common fluid channel with the cells perpendicular to the common fluid channel.

12. The self sealing container of claim 11, wherein the common fluid channel has a means for inflating the container.

13. The self sealing container of claim 11, wherein the container is stored in an uninflated configuration and may be dispensed in any longitudinal length.

14. A self sealing container for holding a fluid comprising:

(a) a first and second array of inflatable cells, each array formed from an outer and inner sheet of fluid impermeable material, said outer and inner sheets being sealed together such that the seal between the inner and outer sheets defines boundaries of the inflatable cells, the inner sheets of the first and second array being sealed together such that each inflatable cell in the first array is sealed to a corresponding cell in the second array forming pairs of cells;

(b) a fill channel between each pair of cells, each channel defined by the seal between the inner sheets between each pair of cells, wherein the channel has an opening through which fluid may be injected into the fill channel and said seal between the inner sheets of each pair of cells defining the fill channel being separate from and inward of the seals defining the boundaries of each cell in each pair of cells; and (c) a first and second aperture within each fill channel spaced from the opening, said first aperture being in the inner sheet of the first array, said second aperture being in the inner sheet of the second array, such that fluid injected into the fill channel may pass through each aperture to fill each inflatable cell, each fill channel being forced to close upon inflation of each pair of cells thereby preventing each pair of cells from discharging or receiving fluid.

15. The self sealing container of claim 14, wherein the inner and outer sheets of each array are constructed from thermoplastic material.

16. The fluid container of claim 15, wherein a viscous fluid is deposited within the fill channel of each element to further restrict fluid flow within each fill channel after inflation of the cells.

17. The self sealing container of claim 14, where in:

(a) the cells of each array are arranged in parallel, with the perimeter of each array being sealed and the cells being separated by longitudinal seals running the length of the cells, the longitudinal seals intersecting the perimeter seal at opposite ends of each cell; and (b) the opening of each fill channel is adjacent to a first side of the container perpendicular to the longitudinal seals, with each fill channel running longitudinally between each pair of cells.

18. The self sealing container of claim 17, further comprising a fluid manifold defined by the fill channels between each pair of cells and a common passage running adjacent to the opening of every fill channel, the common passage being substantially sealed except for an external opening through which external fluid may be injected into the fluid manifold and the openings leading to each fill channel, such that fluid injected into the common passage is forced to flow into every fill channel, subsequently inflating each pair of cells.

19. The self sealing container of claim 18, further comprising a means for inflating the container adjacent to the external opening in the common passage through which fluid may be injected.

20. The self sealing container of claim 18, wherein the common passage is located along the first side of the container adjacent to the openings of the fill channels and extends the width of the container perpendicular to the longitudinal seals.

21. The self sealing container of claim 20, wherein the common passage is defined by:

(a) a widthwise seal between the inner sheets of the first and second arrays adjacent to the first perimeter and extending the width of the container;

(b) seals between the inner sheets of the first and second arrays between openings of neighboring fill channels; and (c) end seals between the inner sheets of the first and second arrays connecting the widthwise seal ends to the openings of the fill channels of the outermost cells in the array.

22. The self-sealing container of claim 21, wherein the external opening in the common passage is located adjacent to an end seal.

23. The self sealing container of claim 20, wherein the common passage is formed using additional thermoplastic material extending substantially straight across the container adjacent to the first side of the container, the common passage being defined by:

(a) a widthwise seal between an edge section of the additional thermoplastic material and an inner side of the inner sheet of a chosen array substantially parallel to the first side of the container and extending substantially straight across the container;

(b) seals between the additional thermoplastic material and the inner side of the inner sheet of the chosen array between openings of neighboring fill channels; and (c) end seals between the additional thermoplastic material and the inner side of the inner sheet of the chosen array connecting the widthwise seal ends to the opening of the fill channels of outermost cells of the arrays.

24. The self sealing container of claim 23, wherein the additional thermoplastic material extends into each fill channel, but does not extend to the apertures, such that upon inflation of the cells the fill channel is forced to close and the additional thermoplastic material provides a barrier which further assists in preventing the discharge of fluid.

25. The self sealing container of claim 14, further comprising:

(a) a circumferential seal between the outer and inner sheets of both arrays along the container perimeter, such that all four sheets are sealed together around the circumferential seal of the container; and (b) an opening between the inner layers of the first and second array, such that fluid injected through the opening between the arrays will be restricted by the circumferential seal and forced into each fill channel to inflate each pair of cells.

26. The self sealing container of claim 25, wherein the inner and outer sheets of each array are constructed from thermoplastic material.

27. The self sealing container of claim 25, wherein a viscous fluid is deposited within each fill channel to further restrict fluid flow within each fill channel after inflation of the cells.

28. The self sealing container of claim 25, wherein the opening between the inner layers is provided with a check valve to restrict the egress of fluid.

29. The self sealing container of claim 25, wherein the opening between the inner layers is provided in the circumferential seal.

30. The self sealing container of claims 1, 2, 3, 4, 5, 6, 7, 8, 11, 9, 12, 13, 10, 14, 15, 17, 18, 20, 21, 22, 19, 23, 24, 16, 25, 26, 27, 28 or 29, wherein the first and second aperture within each fill channel are spatially coincident to allow for communication of fluid between cells in each pair of cells following inflation.

31. A fluid container comprising at least one self sealing inflatable element, each element comprising:

(a) first and second inflatable cells, each cell comprising an outer and inner layer of fluid impermeable material sealed together such that the seal between the outer and inner layers defines the boundaries of each inflatable cell, the inner layer of the first and second cell being sealed together to form a pair of cells;

(b) a fill channel between the pair of cells defined by the seal between the inner layers of the first and second cells, said channel having an opening such that fluid may be injected through the opening into the fill channel; and (c) a first and second aperture within the fill channel spaced from the opening, said first aperture being formed in the inner layer of the first cell, said second aperture being formed in the inner layer of the second cell, such that fluid injected through the opening into the fill channel may pass through the apertures to inflate the inflatable cells and wherein the first and second apertures are spatially coincident to allow for communication of fluid between cells in each pair of cells following inflation, the fill channel being forced to close as the cells are inflated, thereby effectuating a self sealing action by preventing fluid from exiting or entering the cells.

32. A fluid container comprising at least one self sealing inflatable element, each element comprising:

(a) first and second inflatable cells, each cell comprising an outer and inner layer of fluid impermeable material sealed together such that the seal between the outer and inner layers defines the boundaries of each inflatable cell, the inner layer of the first and second cell being sealed together to form a pair of cells;

(b) a fill channel between the pair of cells defined by the seal between the inner layers of the first and second cells, said channel having an opening such that fluid may be injected through the opening into the fill channel and said channel having a viscous fluid deposited within it to restrict fluid flow within the channel after inflation of the cells; and (c) a first and second aperture within the fill channel spaced from the opening, said first aperture being formed in the inner layer of the first cell, said second aperture being formed in the inner layer of the second cell, such that fluid injected through the opening into the fill channel may pass through the apertures to inflate the inflatable cells, the fill channel being forced to close as the cells are inflated, thereby effectuating a self sealing action by preventing fluid from exiting or entering the cells.

33. A self sealing container for holding a fluid comprising:

(a) a first and second array of inflatable cells, each array formed from an outer and inner sheet of fluid impermeable material, said outer and inner sheets being sealed together such that the seal between the inner and outer sheets defines the boundaries of the inflatable cells, the inner sheets of the first and second array being sealed together such that each inflatable cell in the first array is sealed to a corresponding cell in the second array forming pairs of cells with the cells of each array arranged in parallel, the perimeter of each array being sealed and the cells being separated by longitudinal seals running the length of the cells, the longitudinal seals intersecting the perimeter seal at opposite ends of each cell;

(b) a fill channel between each pair of cells, each channel defined by the seal between the inner sheets between each pair of cells, wherein the channel has an opening through which fluid may be injected into the fill channel;

(c) a first and second aperture within each fill channel spaced from the opening, said first aperture being in the inner sheet of the first array, said second aperture being in the inner sheet of the second array, with the opening of each fill channel being adjacent to a first side of the container perpendicular to the longitudinal seals, with each fill channel running longitudinally between each pair of cells such that fluid injected into the fill channel may pass through each aperture to fill each inflatable cell, each fill channel being forced to close upon inflation of each pair of cells thereby preventing each pair of cells from discharging or receiving fluid;

(d) a fluid manifold defined by the fill channels between each pair of cells and a common passage running adjacent to the opening of every fill channel, the common passage being substantially sealed except for an external opening through which external fluid may be injected into the fluid manifold and the openings leading to each fill channel, wherein the common passage is located along the first side of the container adjacent to the openings of the fill channels and extends the width of the container perpendicular to the longitudinal seals, such that fluid injected into the common passage is forced to flow into every fill channel, subsequently inflating each pair of cells; and (e) wherein the common passage is formed using additional fluid impermeable material extending substantially straight across the container adjacent to the first side of the container, the common passage being defined by:

(i) a widthwise seal between an edge section of the additional fluid impermeable material and an inner side of the inner sheet of a chosen array substantially parallel to the first side of the container and extending substantially straight across the container;

(ii) seals between the additional fluid impermeable material and the inner side of the inner sheet of the chosen array between openings of neighboring fill channels; and (iii) end seals between the additional fluid impermeable material and the inner side of the inner sheet of the chosen array connecting the widthwise seal ends to the opening of the fill channels of outermost cells of the arrays.

34. The self sealing container of claim 32, wherein the additional fluid impermeable material extends into each fill channel, but does not extend to the apertures, such that upon inflation of the cells the fill channel is forced to close and the additional fluid impermeable material provides a barrier which further assists in preventing the discharge of fluid.

35. A self sealing container for holding a fluid comprising:

(a) a first and second array of inflatable cells, each array formed from an outer and inner sheet of fluid impermeable material, said outer and inner sheets being sealed together such that the seal between the inner and outer sheets defines the boundaries of the inflatable cells, the inner sheets of the first and second array being sealed together such that each inflatable cell in the first array is sealed to a corresponding cell in the second array forming pairs of cells;

(b) a fill channel between each pair of cells, each channel defined by the seal between the inner sheets between each pair of cells, wherein the channel has an opening through which fluid may be injected into the fill channel and a viscous fluid is deposited within the fill channel of each element to further restrict fluid flow within each fill channel after inflation of the cells; and (c) a first and second aperture within each fill channel spaced from the opening, said first aperture being in the inner sheet of the first array, said second aperture being in the inner sheet of the second array, such that fluid injected into the fill channel may pass through each aperture to fill each inflatable cell, each fill channel being forced to close upon inflation of each pair of cells thereby preventing each pair of cells from discharging or receiving fluid.

36. The self sealing container for holding a fluid of claim 35 further comprising:

(a) a circumferential seal between the outer and inner sheets of both arrays along the container perimeter, such that all four sheets are sealed together around the circumferential seal of the container; and (b) an opening between the inner layers of the first and second array, such that fluid injected though the opening between the arrays will be restricted by the circumferential seal and forced into each fill channel to inflate each pair of cells.

* * * * *